United States Patent [19]

Schütz

[11] 4,163,295

[45] Aug. 7, 1979

[54] POOL COVER

[76] Inventor: Johann Schütz, 11 Willsmere Rd., Kew, Victoria, 3101, Australia

[21] Appl. No.: 818,861

[22] Filed: Jul. 25, 1977

[30] Foreign Application Priority Data

Jul. 26, 1976 [AU] Australia ..... PC6762

[51] Int. Cl.[2] ..... E04H 3/19; E04F 10/00

[52] U.S. Cl. ..... 4/172.14; 135/7.1 R

[58] Field of Search ..... 4/172.14, 172.12; 135/7.1 A, 7.1 R, 5 R, 5 A, 5.1, 5.3

[56] References Cited

U.S. PATENT DOCUMENTS 3,008,148 11/1961 Vierling ..... 4/172.12

3,186,420 6/1965 Magee ..... 135/7.1 A

*Primary Examiner*—Steven L. Stephan

*Attorney, Agent, or Firm*—Cushman, Darby & Cushman

[57] ABSTRACT

A swimming pool cover has a central arm and support arms pivotally attached to the central arm for movement generally in one plane. A sheet of flexible, waterproof material is attached to each of the arms and extends between the arms. The central arm is pivoted to move in a vertical plane, and is raised and lowered by means of a manually operated rack and pinion gear located in a post. The post is supported by a swivel mount set in the pool surrounds so that the central arm may be rotated from a position over the pool to one over the pool surrounds. A manually operated endless chain within the central arm carries a plate pivotally attached to retracting arms which are in turn pivotally attached to the outermost support arms. Movement of the endless chain and hence the plate serves to open and close the arms and hence the cover. A cable threaded through loops along the edge of the sheet of cover material and running over pulleys inserted in sleeves in the pool surrounds, when tensioned by a winch, prevents entry into the pool when the cover is in a fully lowered position.

12 Claims, 4 Drawing Figures

POOL COVER

BACKGROUND OF THE INVENTION

This invention relates to a cover, and in particular relates to a cover for a swimming pool.

In recent years, many young children have accidentally fallen into domestic swimming pools, and have drowned. Many proposals have been advanced to prevent such unfortunate occurrences. It has, for example, been suggested to build fences around swimming pools.

The most practical way to prevent a child from falling into a swimming pool is to cover the pool. Covers are also useful for keeping dirt out of a pool when it is not in use, to prevent evaporation of the pool water, and to maintain the temperature of the water in a heated pool.

Many types of pool covers are in existence, but none has proved to be totally satisfactory, particularly for "below-ground" pools. "Below-ground" pools are more difficult to cover, because they are usually larger than "above-ground" pools and because they are situated below ground level, which later feature may allow a child to crawl beneath a cover and fall into the pool.

In addition covers which simply consist of a flexible waterproof material are unsatisfactory because they tend to form a concave surface, which collects rainwater. There have been documented instances where children have fallen into this concavity, and have drowned in such a pool of rainwater. Covers which are secured to the surrounds of a pool in order to prevent such entry into the pool suffer from the disadvantage of being very inconvenient to remove, taking some considerable time to remove and store away from the pool.

SUMMARY OF THE INVENTION

In view of the foregoing, the principal object of this invention is a cover which can safely cover a swimming pool, and can be quickly removed and stored when it is desired to use the pool.

The invention provides a cover, including a central arm pivotally attached to a support for pivotal movement in a generally vertical plane about said support, means for pivoting said central arm in said generally vertical plane, at least two support arms, one end of each support arm being attached to said central arm, at least one of said support arms being pivotally attached to said central arm, said or each pivotally attached support arm adapted for pivotal movement substantially in a plane in which all support arms lie, means for moving said or each pivotally attached arm between a position where all support arms are generally parallel, and a position where all support arms are radially disposed, and a sheet of flexible material attached to each support arm and extending therebetween.

The invention may additionally include means to secure the edges of said flexible material to a surface upon which said cover rests when said central arm is in a lowered position.

The invention may further provide that said central arm is pivotally attached to a post, said post being adapted for rotational movement about a vertical axis.

DETAILED DESCRIPTION

Figure 1:
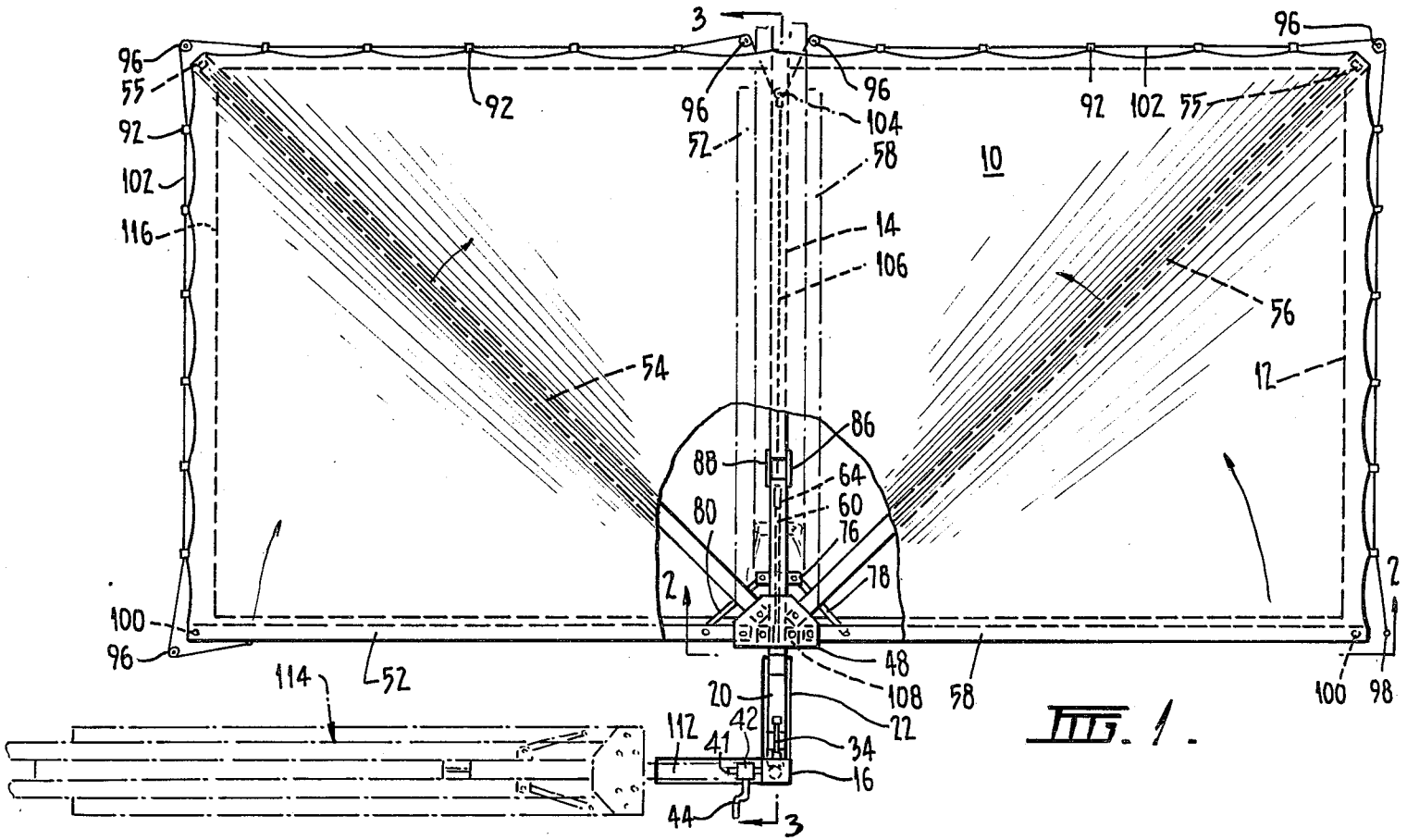
FIG. 1 is a top plan view of a cover, according to the present invention, in its extended position.

Referring firstly to FIG. 1, the cover 10 is adapted to be used to cover a rectangular "below-ground" pool, the outline of which is shown by the unbroken and broken lines 12. It is to be understood that the cover of this invention may be used to cover a pool of any shape.

Figures 2, 3, 4:
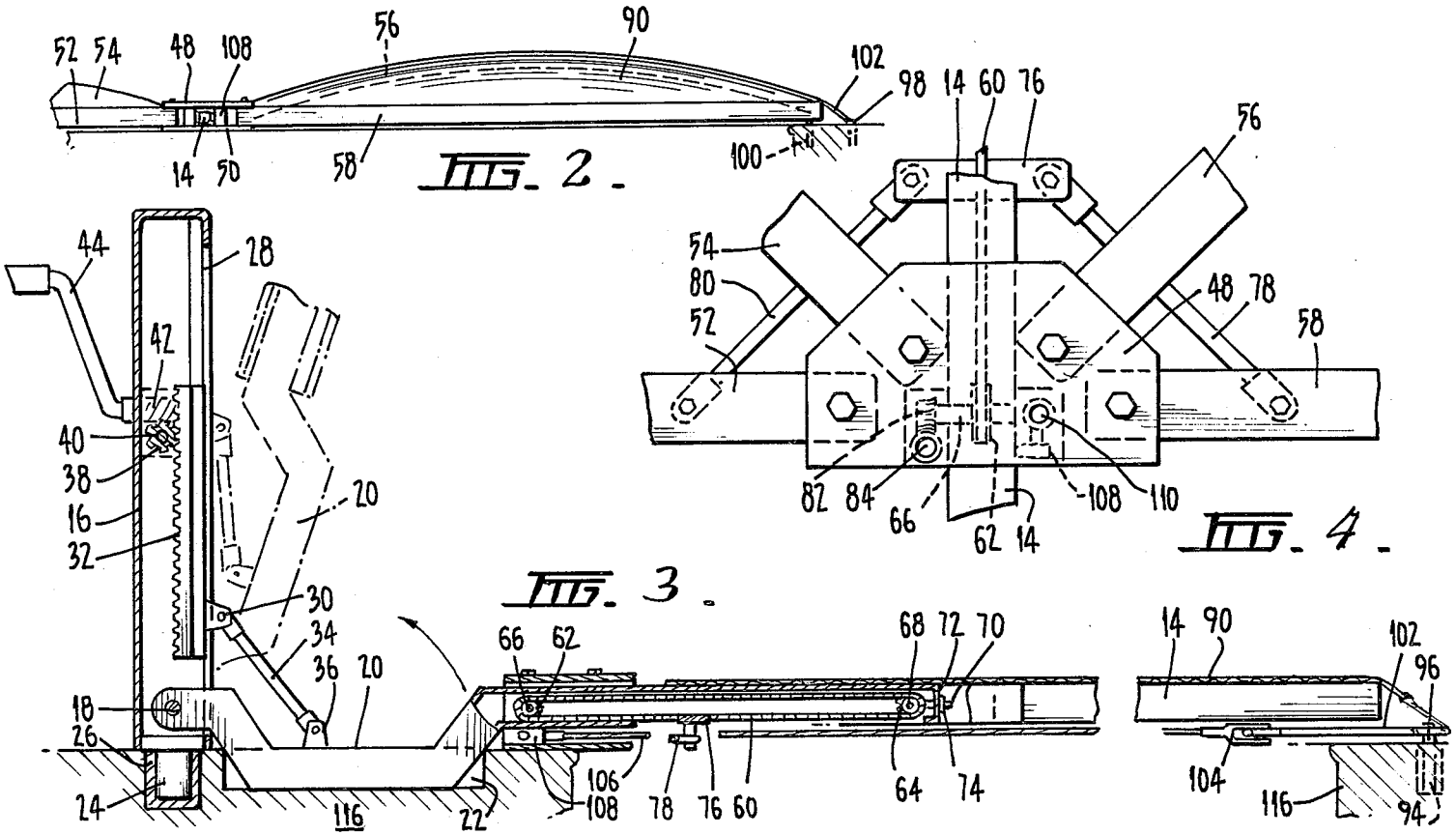
FIG. 2 is a cross-sectional view along the lines 2—2 of FIG. 1.
FIG. 3 is a cross-sectional view along the lines 3—3 of FIG. 1.
FIG. 4 is an enlarged top plan view of a portion of the cover of FIG. 1.

The cover includes a central arm 14 which is pivotally attached by a horizontal axle 18 to a post 16, to enable the arm 14 to pivot upwards from the horizontal position shown in FIG. 3. The arm 14 has a U-shaped bend 20 which, when the arm is in the horizontal position of FIG. 3 rests in a steel reinforced trench 22 in the pool surrounds. This enables a person to walk between the post 16 and the cover 10, without stumbling over the arm 14.

The post 16 is mounted in the pool surrounds 116 for movement around a swivel mount comprising a vertical cylindrical axle 24, which rotates in a cylindrical sleeve 26 set in the pool surrounds 116.

Post 16 is cuboidal, and hollow, and has an elongated slot 28 in one face thereof. The slot 28 has wide portion at the lower end thereof to accommodate a portion of arm 14 when the arm is raised about pivot 18. The upper portion of slot 28 accommodates a plate 30, which extends through the slot from the rear of a rack 32 situated inside post 16.

Plate 30 is pivotally attached to one end of support arm 34. The other end of support arm 34 is pivotally attached to a plate 36 extending from portion 20 of arm 14. A pinion 38, which meshes with rack 32, is mounted on a shaft 40 which is rotatably mounted inside post 16. One end of shaft 40 extends outside post 16, and has a worm wheel 41 secured thereto. The worm wheel meshes with a worm 42 which is rotated by a removable crank 44. The worm wheel and worm are located in a box 46 attached to one side of post 16.

Turning now to the cover 10 proper, and to FIGS. 1, 2 and 4 in particular, there are two hexagonal plates 48, 50 attached to the top and bottom of central arm 14 respectively. Movable arms 52, 54, 56, 58 are pivotally attached to and between plates 48 and 50, as is clearly shown in FIG. 4. Arms 54 and 56 have a bowed shape, as shown in FIG. 2, but arms 14, 52 and 58 are straight. The underside of the ends of arms 54, 56 are provided with castor wheels 55 adapted to rest on pool surrounds 116 and to permit arms 54, 56 to move in a limited arc on pool surrounds 116. The reason for the shape of arms 54 and 56 will be discussed hereinafter.

Within arm 14, there is situated an endless chain 60, which runs in a vertical plane over sprockets 62 and 64. Sprocket 62 is mounted on a horizontal shaft 66 rotatably mounted on arm 14, and sprocket 64 is rotatably mounted on a horizontal shaft 68 attached to a bifurcated member 70 which extends through and is supported by an internal wall 72 in arm 14. The remote end of member 70 is threaded, and receives a nut 74 which may be turned to tension chain 60.

A horizontal plate 76 is attached to the lower run of chain 60. Plate 76 extends in both directions through corresponding slots in both sides of arm 14. One end of plate 76 is pivotally attached to one end of a retracting arm 78. The other end of retracting arm 78 is pivotally attached to the underside of arm 58. Similarly, a second retracting arm 80 is pivotally attached to the other end of plate 76 and to the underside of arm 52.

Shaft 66 extends from arm 14, and has a worm wheel 82 attached thereto, which worm wheel meshes with a worm (not shown) rotated by means of a crank (not shown but preferably the same crank as crank 44) inserted in aperture 84.

Arm 14 is formed from two portions, which may include a portion of relatively heavy gauge and a portion of lighter gauge, the two portions being joined by plates 86, 88 (FIG. 1). This also enables nut 74 to be turned.

A generally rectangular planar sheet of flexible, waterproof, reinforced material 90 is fastened to arms 14, 52, 54, 56 and 58 in that each arm lies in a respective sleeve formed in the sheet. Loops 92 are provided around the three edges of the material not occupied by arms 52, 58.

In the pool surrounds, small sleeves 94 are set in predetermined positions for the removable retention of horizontal pulleys 96, cable pin 98, and arm locating pins 100. One end of a cable 102 is attached to cable pin 98 which is retained in a sleeve. The cable is threaded through loops 92 and guided around pulleys 96 also retained in respective sleeves. The other end of cable 102 is attached to arm 52.

Cable 102 also passes through equalising pulley 104 which is attached to cable 106. Cable 106 passes under arm 14 to a conventional manual winch 108, details of which are not shown, which may be operated by a crank inserted in aperture 110. The crank is preferably that used to operate chain 60.

In the same relative position to post 16 as trench 22, but at right angles thereto is an identical steel reinforced trench 112. A cover storage locker in the form of a garden seat 114 is provided to receive a folded cover in a manner to be described hereinafter.

The operation of the pool cover will be described as follows:

From the fully fitted position shown in FIG. 1, the first step is to relax cable 102 by releasing winch 108. This enables cable pin 98 and pulleys 96 to be removed from sleeves 94 and stored. Locating pins 100 on arms 52 and 58 may be removed from their respective sleeves 94 by lifting the arms.

Crank 44 is then placed in the position shown in FIG. 3, and rotated, to cause pinion 38 to rotate, which in turn raises rack 32. The movement of rack 32 and plate 30 attached thereto, raises arm 14 about pivot 18 through support arm 34. If continued, the arm 14 may be raised to the position shown in broken lines in FIG. 3. Normally, when the cover 10 is to be stored, it will be eventually raised to such a height, but in order to collapse the cover, it is only necessary initially to raise the arm 14 so that the cover is raised from the pool surrounds.

If the pool is heated, and it is desired to have a quick swim, for instance in the morning, it is possible to raise arm 14 to an angle of approximately 40°. It is then possible to enter the pool from the side opposite to that near which the post 16 is situated, to swim in the pool under the partly raised cover, and to subsequently replace the cover. If the cover is to be stored, once the cover is clear of the surrounds, crank 44 is inserted in aperture 84 and rotated anticlockwise, to rotate the worm (not shown) worm wheel 82, sprocket 62 and chain 60, thereby causing plate 76 to travel along the slots in arm 14 away from sprocket 62. The movement of plate 76 draws arms 52 and 58, through arms 78 and 80, in the direction of the arrows in FIG. 1. When arms 52 and 58 approach arms 54 and 56 respectively, they push those arms in the direction of the arrows in FIG. 1 associated with those arms. Eventually, arms 14, 52, 54, 56 and 58 reach the position shown in broken lines in FIG. 1, where they are substantially parallel.

At this stage, crank 44 is returned to the position shown in FIG. 3, and arm 14 is raised further. Once the arm 14 has reached the position shown in broken lines in FIG. 3, post 16 may be manually rotated, until cover 10 is above seat 114. The seat will normally have a hinged top and a slot in the end nearest post 16 to accommodate arm 14. The top is opened, and cover lowered into the seat, until the seat supports the cover, and the portion 20 of arm 14 lies in trench 112. The top may be closed and the seat used for its other purpose.

To replace the cover, an operation in reverse to that described hereinbefore is carried out. The cover 10 is removed from the seat 114, positioned over the pool opened fully, and lowered so that the ends of arms 14, 54 and 56 and all of arms 52 and 58 rest on the pool surrounds. Arm locating pin 100 on arm 58 is inserted into its respective sleeve 94. Pulleys 96 and cable pin 98 are also inserted into their respective sleeves. Cable 102 is guided around pulleys 96, and then winch 108 is operated to tension the cable. Apart from ensuring that a child cannot crawl under the sides of the pool, the cable tensioning tends to pull arm 52 into its correct position against the pull of the material 86, which is quite heavy, and tends to assume a concave position, thereby pulling arm 52 towards the pool. Once arm 52 is in its correct position its locating pin 100 may be inserted into its sleeve 94.

In its fully fitted position with cable tensioned, the cover assumes the position shown in FIG. 1. The fact that arms 54 and 56 are bowed as shown in FIG. 2, and that cable 102 pulls the material 86 taut by ensuring that arm 52 is in position, means that there is no way pools of water can collect on the top of the cover. In some states and countries, pool covers must satisfy this requirement, so that drownings in pools of water on pool covers as discussed hereinbefore cannot occur.

It can be seen that various modifications of the embodiment illustrated in FIGS. 1 to 4 may be made without affecting the invention. For instance, it is preferred to use hollow rectangular-section aluminum tube for the arms, but it may be convenient to use steel or other metals or alloys. A 12 volt electric motor with a 4:1 reduction gear may replace the manually crank operated raising and lowering means, and similarly electric or hydraulic motors may operate winch 108 or endless chain 60. The cover 10 may be, in its closed position, stored behind a low wall or in any other manner.

What I claim is:

1. A collapsible swimming pool cover comprising: a central arm; a plurality of support arms having inner ends and free outer ends; means pivotally connecting said support arms at locations near the inner ends thereof to said central arm for swinging movement about generally parallel axes, said pivotal connecting means being located such that said support arms are swingable in generally the same plane between a collapsed position wherein the support arms are generally parallel and an expanded position wherein the support arms extend generally radially from said pivotal connecting means, means pivotally connecting said central arm to a support for swinging movement in a generally vertical plane between a first position in which said support arms are generally horizontal and a second position in which support arms are raised; a sheet of flexible pool-covering material attached to all said support arms in a manner such that said material becomes folded and unfolded as said support arms move to their collapsed and expanded positions, said sheet having an edge, free of rigid supports extending between the free outer ends of adjacent support arms; first power transmission means for swinging said central arm between its first and second positions; and second power transmission means for moving said support arms between their collapsed and expanded positions.

2. A pool cover according to claim 1, wherein a support arm not pivotally attached to said central arm is rigidly attached to said central arm.

3. A pool cover according to claim 2, wherein said rigidly attached support arm and said central arm are parallel.

4. A pool cover according to claim 2, wherein said central arm is also a support arm and wherein said sheet of flexible material is attached to said central arm.

5. A pool cover according to claim 1, wherein there are four pivotally attached support arms, two on each side of said central arm, said arms lying generally in one place in the open or closed position of said cover.

6. A pool cover according to claim 5, wherein the two pivotally attached support arms nearest said central arm are convexly bowed, and the two pivotally attached support arms furthest from said central arm are those associated with said means for moving said or each pivotally attached support arm.

7. A pool cover as in claim 1 wherein said central arm has an outer end and an inner end and wherein said means for pivotally connecting said central arm to said support cooperates with said central arm near the inner end of the latter.

8. A pool cover, including a support post adapted for rotational movement about a vertical axis, a central arm pivotally attached to said post for pivotal movement in a generally vertical plane about said post, means for pivoting said central arm in said generally vertical plane, at least two support arms, at least one of said support arms being pivotally attached to said central arm, said or each pivotally attached support arm being adapted for pivotal movement substantially in a plane in which all support arms lie, means for moving said or each pivotally attached arm between a position where all support arms are generally parallel, and a position where all support arms are radially disposed, and a sheet of flexible material attached to the support arms and extending between adjacent support arms so as to become folded or unfolded during pivotal movement of the support arms, said means for pivoting said central arm being a raising and lowering means carried by said post, said means comprising a rack adapted for vertical movement, a pivotal arm, one end of which is pivotally attached to said rack, the other end of which is pivotally attached to said central arm, and a pinion rotatable about a generally horizontal axis spacially fixed with respect to said post, said pinion cooperating with said rack such that rotation of said pinion in one direction causes said rack to move in an upward direction, thereby causing upwardly pivoting movement of said pivotal arm, which in turn causes said central arm to be raised, and rotation of said pinion in the other direction causes said rack to move in a downward direction, thereby causing downwardly pivoting movement of said pivotal arm, which in turn causes said central arm to be lowered.

9. A pool cover according to claim 8, wherein said pinion is mounted on a shaft, said shaft also having a worm wheel mounted thereon, and a worm meshing with said worm wheel whereby rotation of said worm causes rotation of said pinion.

10. A pool cover according to claim 9, including a removable manual crank for rotating said worm.

11. A pool cover, including a support and a central arm pivotally attached to said support for pivotal movement in a generally vertical plane about said support, means for pivoting said central arm in said generally vertical plane, at least two support arms, at least one of said support arms being pivotally attached to said central arm, said or each pivotally attached support arm being adapted for pivotal movement substantially in a plane in which all support arms lie, means for moving said or each pivotally attached arm between a position where all support arms are generally parallel, and a position where all support arms are radially disposed, and a sheet of flexible material attached to the support arms and extending between adjacent support arms so as to become folded or unfolded during pivotal movement of the support arms, said means for moving said pivotally attached support arm comprising an endless chain located within said central arm, said chain lying in a generally vertical plane and being supported and rotated by two spaced vertical sprockets, one of which is mounted upon a shaft rotatably attached to said central arm, there being a worm wheel mounted on said shaft, said worm wheel meshing with a worm rotatable by manual means, a plate attached to said endless chain, and a retracting arm, one end of which is pivotally attached to said plate, the other end of which is pivotally attached to said pivotally attached support arm.

12. A pool cover, including a support and a central arm pivotally attached to said support for pivotal movement in a generally vertical plane about said support, means for pivoting said central arm in said generally vertical plane, at least two support arms, at least one of said support arms being pivotally attached to said central arm, said or each pivotally attached support arm being adapted for pivotal movement substantially in a plane in which all support arms lie, means for moving said or each pivotally attached arm between a position where all support arms are generally parallel, and a position where all support arms are radially disposed, and a sheet of flexible material attached to the support arms and extending between adjacent support arms so as to become folded or unfolded during pivotal movement of the support arms, a pool border, means to secure edges of said sheet of flexible material to said border when said central arm is in a lowered position, said securing means including a cable, one end of which is secured to a cable pin inserted in a sleeve in said border, the other end of said cable being attached to said pivotally attached support arm, said cable passing through a plurality of loops attached to the edge of said sheet and passing over horizontal pulleys located in sleeves in said surface near the ends of each arm, said cable also passing through an equalizing pulley located near said central arm, said equalizing pulley being attached to a second cable which is in turn attached to a winch adapted to tension said cables.

* * * * *